United States Patent [19]

Matsuo

[11] 4,447,006

[45] May 8, 1984

[54] CAM TYPE ELASTIC RAIL FASTENING DEVICE

[75] Inventor: Yoshio Matsuo, Tokyo, Japan

[73] Assignee: Tetsudo Kizai Kogyo Company Limited, Tokyo, Japan

[21] Appl. No.: 356,752

[22] Filed: Mar. 10, 1982

[51] Int. Cl.[3] ..... E01B 9/30

[52] U.S. Cl. ..... 238/341; 238/349; 238/351; 238/360

[58] Field of Search ..... 238/349, 351, 360, 341, 238/317, 333, 310, 338

[56] References Cited

U.S. PATENT DOCUMENTS 1,863,039 6/1932 Chandler ..... 238/341
3,451,621 6/1969 De Splinter ..... 238/349
3,831,842 8/1974 Tomura ..... 238/349
4,143,818 3/1979 Matsubara et al. ..... 238/349

FOREIGN PATENT DOCUMENTS 683961 12/1952 United Kingdom ..... 238/349

*Primary Examiner*—Robert B. Reeves
*Assistant Examiner*—Donald Hajec
*Attorney, Agent, or Firm*—Howson and Howson

[57] ABSTRACT

A cam actuated elastic rail securing device comprises a spring member which is adapted to engage the flange of a rail and to cooperate with a rotary cam element to apply an elastic restraining force to the rail when the cam is rotated relative to an anchor and slid axially to lock the cam against reverse rotation.

4 Claims, 14 Drawing Figures

CAM TYPE ELASTIC RAIL FASTENING DEVICE

FIELD OF THE INVENTION

This invention relates to a cam type elastic rail fastening device and more particularly to the improvement of an elastic rail fastening device wherein a cam for imparting an elastic force to a rail securing spring can maintain a rail in a safely secured state without being reversely displaced in a normal state of operation by the vibration from a running train or by other causes.

BACKGROUND OF THE INVENTION

Various types of elastic fastening devices have been proposed for securing a railroad rail onto a concrete bed, a concrete slab or a tie made of concrete, iron or wood with a spring instead of using screws, etc. In these conventional elastic fastening devices, however, the structure of the spring is complicated, and the mounting of the spring is troublesome. Moreover, when installing the device for imparting a rail-securing elastic force to the spring, it is necessary to elastically-deflect the spring by using a separate tool, thus rendering inefficient the rail securing work.

OBJECTS OF THE INVENTION

It is a primary object of this invention to provide an elastic rail fastening device whereby the rail securing work can be performed efficiently and effectively enough to prevent the securing force from weakening due to the vibration from a running train, etc. after completion of the rail securing work.

It is another object of this invention to provide an elastic rail fastening device which requires only a small number of components and which is less expensive to manufacture than prior art devices.

SUMMARY OF THE INVENTION

More specifically, the present invention provides a device for elastically clamping a rail to a base. The device includes an anchor embedded in the base alongside the rail, a cam element mounted to the anchor for combined rotary and sliding movement, and a spring member having portions shaped to engage the rail and to cooperate with the cam and anchor to apply the elastic clamping force after the cam has been rotated and slid axially into a locking position within the spring member.

BRIEF DESCRIPTION OF THE DRAWINGS

An embodiment of this invention will be described hereinunder with reference to the accompanying drawings in which.

DESCRIPTION OF PREFERRED EMBODIMENT

Figure 1:
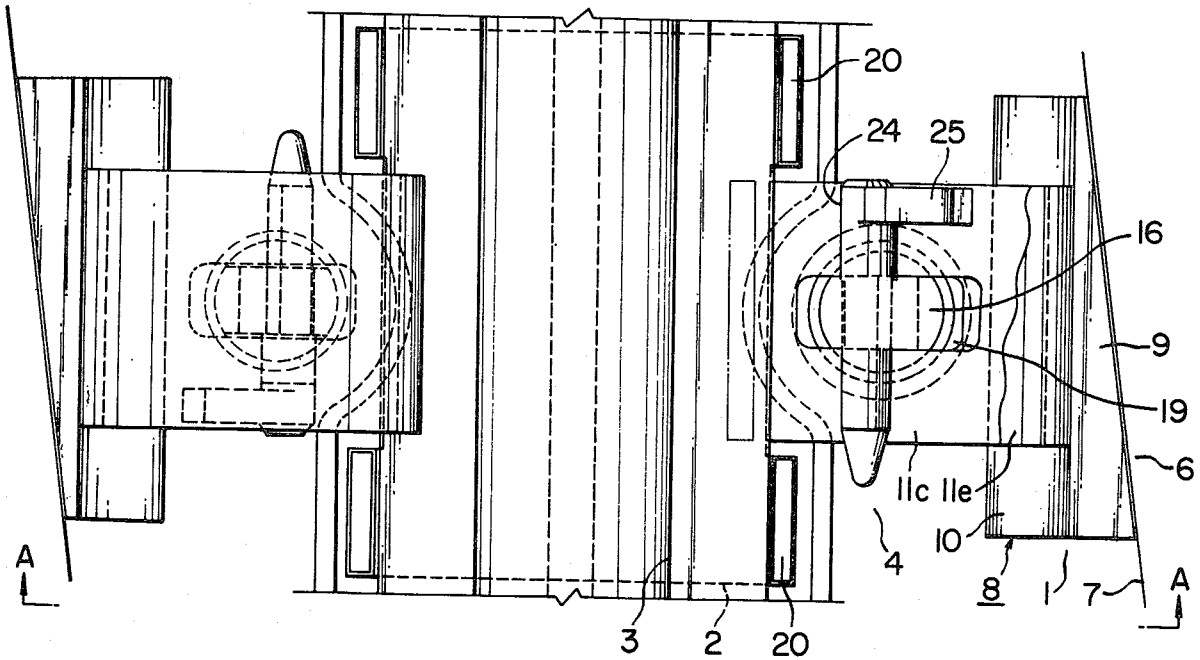
FIG. 1 is a plan view of a cam type elastic rail fastening device according to an embodiment of the present invention.
Figure 2:
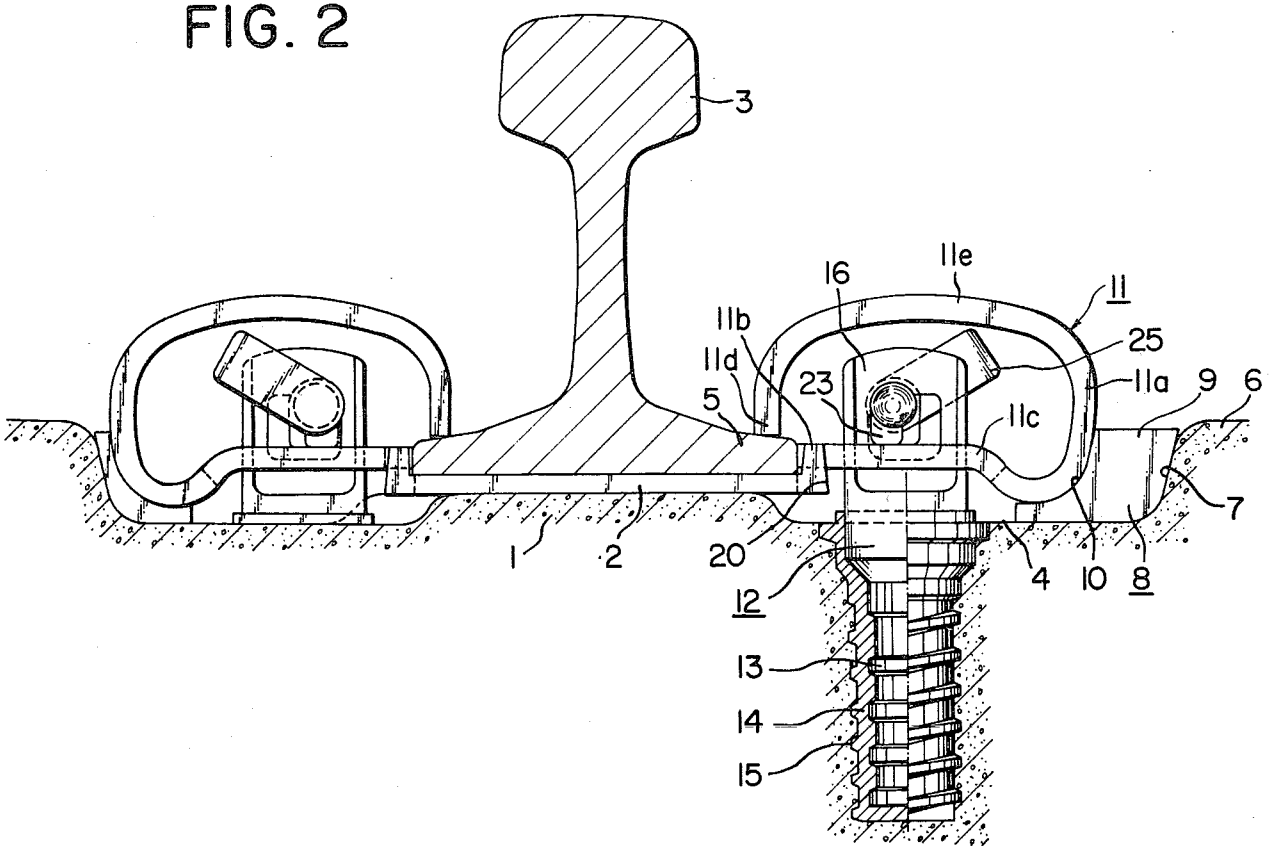
FIG. 2 is an elevation taken on line A—A of FIG. 1, wherein an anchor is shown partly in section.
Figure 3:
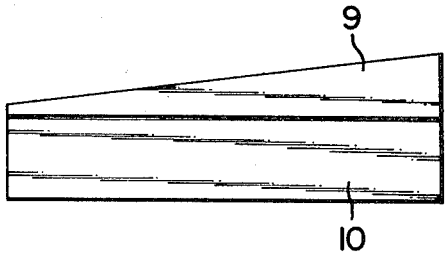
FIG. 3 is a plan view of a spring receiver.
Figure 6:
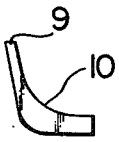
FIGS. 5 and 6 are side views thereof.
Figure 4:
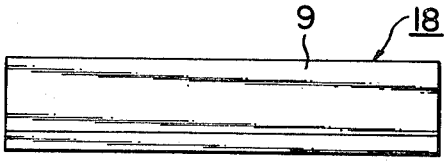
FIG. 4 is an elevation thereof.
Figure 5:
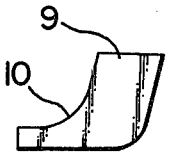

Referring first to FIGS. 1 and 2, there is shown a rail in a secured state wherein a track pad 2 is placed on a rail support 1 such as a concrete tie, and a rail 3 is laid thereon. On both sides of the pad 2 there are formed, integrally with the support 1, a recess 4 which is lower than the pad 2 and a spring receiver guide 6 which is higher than a rail flange 5, the guide 6 being formed at an outside end of the recess 4. The spring receiver guide 6 has an inside surface 7, the inside surfaces 7 on both sides of the rail 3 being inclined parallel with one another in the longitudinal direction of the rail 3, and a spring receiver 8 made of a synthetic resin is placed on the recess 4 and in contact with the inside surface 7. As shown in FIGS. 3 through 6, the spring receiver 8 is of a known structure such that a bearing surface 10 scooped out in the form of a generally quadrant arc extending parallel with and in the longitudinal direction of the rail 3 is formed inside of a rise portion 9 which contacts the inside surface 7. An outside end portion 11*a* of a spring clip 11 is supported on the bearing surface.

Figure 7:
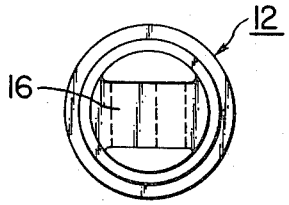
FIG. 7 is a plan view of the anchor.
Figure 8:
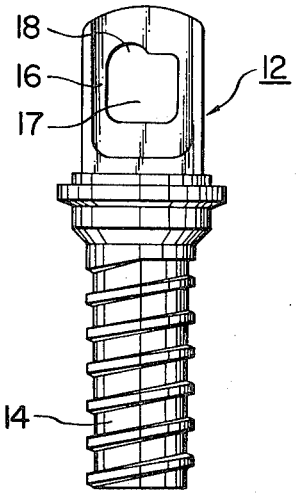
FIG. 8 is an elevation thereof.

An anchor 12 is buried and fixed into the support 1 at an intermediate portion between the rail flange 5 and the spring receiver 8. The anchor 12 has several gripping or anti-falloff flanges 13. If required, the portion of the anchor 12 buried in the support 1 may be enclosed with an electrical insulating material 14, and the anchor 12 is fixed to the support 1 strongly through a spring projection 15 formed on the outer peripheral surface of the insulator 14. A head portion 16 of the anchor 12 projecting above the recess 4 has a slender, flat shape in the direction normal to the longitudinal direction of the rail 3 and is formed by partially cutting off its both sides in that longitudinal direction (see FIGS. 7 and 8). A generally square-shaped cam insertion hole 17 is formed in the head portion 16, and in its upper side portion closer to the rail 3 there is formed an arcuate recess 18.

Figure 9:
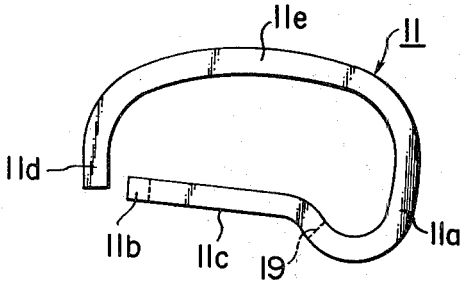
FIG. 9 is an elevation of a spring clip.
Figure 10:
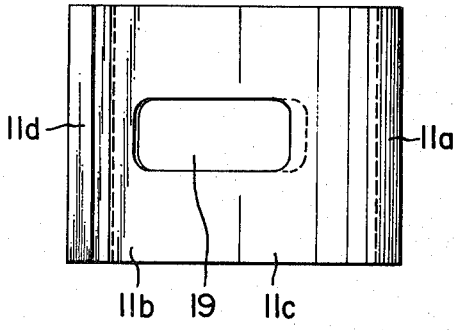
FIG. 10 is an underside view thereof.

The spring clip 11 is made of a leaf spring steel of a size capable of securing the rail 3 with a sufficient elastic force and, as shown in FIGS. 9 and 10, it is comprised of integrally bent lower spring portion 11*c* and upper spring portion 11*e*, the lower spring portion 11*c* extending from the outside end portion 11*a* slightly upwards in the direction of the flange 5 so that its tip end 11*b* contacts the side of the flange 5 at the time of rail securing, while the upper spring portion 11*e* is curved from the outside end portion 11*a* beyond above the anchor 12 so that its tip end 11*b* abuts the upper surface of the flange 5. The lower spring portion 11*c* has a rectangular through hole 19 through which the anchor head portion 16 passes loosely.

For mounting the spring clip 11, the anchor head portion 16 is inserted in the hole 19, then the outside end portion 11*a* of the spring clip 11 and the tip end 11*d* of the upper spring portion 11*e* are placed on the bearing surface 10 and on the upper surface of the flange 5, respectively, and the tip end 11*b* of the lower spring portion 11*c* is brought into slight contact with the outside surface of the flange 5 by striking an end face of the spring receiver 8 with a hammer. In this state, the lower spring portion 11*c* is in a non-depressed position indicated in FIG. 14 between front and rear flanges 20 formed at the four corners of the pad 2, and it partially covers the lower portion of the hole 17.

Figure 13:
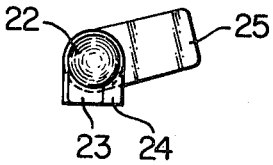
FIG. 13 is a side view thereof.
Figure 11:
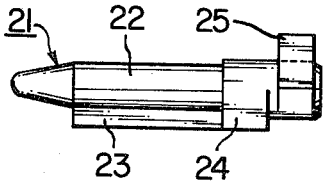
FIG. 11 is an elevation of a cam.
Figure 12:
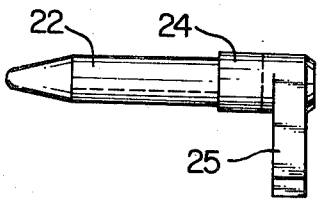
FIG. 12 is a plan view thereof.

Referring now to FIGS. 11 through 13, there is shown a steel cam 21 to be inserted in the hole 17. The cam 21 comprises a cylindrical portion 22 having a rounded cone-shaped tip end portion; a cam portion 23 which projects from the lower portion of the cylindrical portion 22 in a one-sided manner; a stopper portion 24 formed at the rear end of the cylindrical portion 22, the upper half portion of the stopper portion 24 being in the form of a semi-cylinder having a larger radius than that of the cylindrical portion 22 and the lower half portion thereof being square-shaped with its underside coincident with the cam portion 23; and a lever 25 formed further behind the stopper portion 24 and on the side opposite to the aforesaid biased side, the lever 25 being inclined upwards and projecting sideways being offset at an oblique angle with respect to the camming portion or lobe 23 as illustrated in FIG. 13, the portions 22, 23, 24 and the lever 25 being formed integrally, and the lower edge of the cam portion 23 is rounded.

Figure 14:
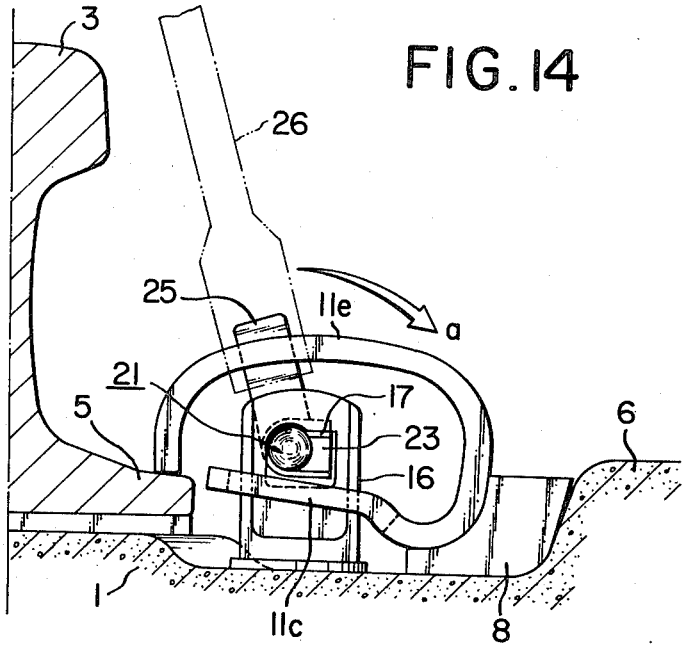
FIG. 14 is an elevational view illustrating the rail being secured.

As shown in FIG. 14, at the upper portion of the lower spring portion 11*c* which is in the foregoing non-depressed position, the cylindrical portion 22 is inserted in the hole 17 in such a position that the cam portion 23 turns sideways in the direction opposite to the rail 3. At this time, the cylindrical portion 22 is within the recess 18, while the lever 25 is at the outside of the upper spring portion 11*e* and projects obliquely upwards therefrom beyond the upper spring portion 11*e* as shown in FIG. 14. If the lever 25 is inserted in the tip end hole of a cam turning wrench 26 and the cam 21 is turned in the direction of arrow (a) with the wrench 26, the cylindrical portion 22 rotates in contact with the inner surface of the recess 18 and the cam portion 23 slides on the lower spring portion 11*c* and presses down the latter. When the underside of the cam portion 23 contacts the lower spring portion 11*c*, the tip end 11*b* of the lower spring portion 11*c* abuts the side of the flange 5, and the elastic force induced by the aforesaid downward movement of the lower spring portion 11*c* causes the upper spring portion 11*e* to undergo an elastic deflection whereby the flange 5 is secured tightly through the tip end 11*d*. Then, the wrench 26 is pulled out and the lever 25 is slid into position below the upper spring portion 11*e* (see FIG. 1) by striking the rear end of the cam 21. This completes the rail securing work.

In this secured state, the cam portion 23 is strongly pressurized by the lower spring portion 11*c*. Thus, the cam 21 is not likely to turn in the opposite direction and thereby loosen, and it is not likely to slide to the rear due to the vibration from a running train or by other causes. Hence, as best seen in FIGS. 2 and 14, since the lever 25 has a length greater than the spacing between the anchor 16 and the upper spring portion 11*e*, the lever 25 is always below the upper spring portion 11*e* and is in a locked state to prevent the reverse rotation of the cam 21, the rail securing force will never weaken.

According to the present invention having the hereinbefore described construction, not only the rail can be elastically secured safely and surely, but also the cam can be inserted in a predetermined position with respect to the rail without the necessity of using a special tool for pressing down a strong spring clip. The securing work is completed by merely turning a cam and striking it with a hammer. Consequently, the present invention enables the rail securing work to be performed efficiently with a device having a minimum number of parts in a simple structure which is economical to manufacture.

I claim:

1. A cam type elastic rail fastening device comprising:

an anchor having a lower portion fixed to a rail support on a side of a rail and further having a head portion, said head portion having a cam insertion hole formed in the longitudinal direction of the rail;

a spring clip comprising a lower spring portion and an upper spring portion, said lower spring portion and said upper spring portion being formed integrally with each other, a tip end of said lower spring portion being in abutment with a side of a flange of the rail laid on said rail support and an outside end portion of said lower spring portion being supported by a spring receiver so as to be prevented from moving outwards with respect to the rail, said lower spring portion having a hole through which said head portion projects, said upper spring portion rising from said outside end portion of said lower spring portion and extending beyond said head portion of said anchor so that its tip end comes into elastic contact with the upper surface of said flange; and a cam inserted into said cam insertion hole above said lower spring portion and rotated in one direction to impart a predetermined elastic deflection to said lower spring portion thereby creating an elastic securing force against said flange at the tip end of said upper spring portion, said cam having a cylindrical portion, a cam portion formed on one side of said cylindrical portion for urging said lower spring portion downwardly, and a lever for performing said cam rotation, said lever being dimensioned with respect to said cam insertion hole and upper spring portion to pass between said upper and lower spring portions when said cam portion is engaged with said lower spring portion and to engage said upper spring portion to limit rotation of said cam element in a direction opposite said one direction, said cam being inserted in said anchor with its lever under said upper spring portion by driving said cam further into said cam insertion hole after said cam rotation to thereby prevent rotation of said cam in said opposite direction and hence loosening of said clamping device.

2. A cam type elastic rail fastening device according to claim 1, wherein said cam insertion hole has an upper side with an arcuate recess formed therein for insertion of said cylindrical portion of said cam.

3. A cam type elastic rail fastening device according to claim 1, wherein said cam portion is disposed toward the rail with respect to said cylindrical portion in a secured state of the rail.

4. A device for clamping a rail to a base, comprising: an anchor mounted in said base and having a head projecting upwardly therefrom, a cam element mounted in said anchor for rotation about an axis parallel to said rail and for sliding motion lengthwise of its rotational axis, a spring member having an upper portion overlying said anchor and a lower portion receiving said upper portion of said anchor, said upper portion terminating in a downturned tip engaging said rail and said lower portion terminating adjacent said rail, means located outwardly of said anchor supporting said spring member remote from its tip, said cam element having a lobe and a lever, said cam lever being offset angularly with respect to said lobe and having a length greater than the spacing between the anchor and upper portion of the spring member, said cam element adapted, when said lobe is engaged with said lower portion of the spring member and said lever inclined away from the rail, to be slid axially into position beneath said upper portion of the spring member, whereby said spring member both clamps the rail and prevents the cam element from loosening inadvertently.

* * * * *